US007716858B2

(12) United States Patent
Lee

(10) Patent No.: US 7,716,858 B2
(45) Date of Patent: May 18, 2010

(54) IRON

(76) Inventor: Jung-Min Lee, 112-1304, Woo Sin Apt., Mora-dong, Sasang-gu, Busan-city 617-755 (KR)

( * ) Notice: Subject to any disclaimer, the term of this patent is extended or adjusted under 35 U.S.C. 154(b) by 207 days.

(21) Appl. No.: 11/922,717

(22) PCT Filed: Feb. 24, 2006

(86) PCT No.: PCT/KR2006/000654

§ 371 (c)(1),
(2), (4) Date: Dec. 21, 2007

(87) PCT Pub. No.: WO2007/004779

PCT Pub. Date: Jan. 11, 2007

(65) Prior Publication Data

US 2009/0223097 A1 Sep. 10, 2009

(30) Foreign Application Priority Data

Jul. 5, 2005 (KR) ..... 10-2005-0059981

(51) Int. Cl.
*D06F 75/38* (2006.01)
*D06F 75/30* (2006.01)

(52) U.S. Cl. ..... 38/93; 38/81

(58) Field of Classification Search ..... 38/74, 38/75, 80, 81, 82, 88, 93, 97; D32/68, 70, D32/71

See application file for complete search history.

(56) References Cited

U.S. PATENT DOCUMENTS 984,673 A * 2/1911 House ..... 38/71
1,095,925 A * 5/1914 Pogue ..... 38/71
1,950,498 A * 3/1934 Lehnen et al. ..... 38/71
1,972,035 A * 8/1934 Schwartz ..... 38/93
2,065,366 A * 12/1936 Eichorn ..... 38/93
2,408,209 A * 9/1946 Gould ..... 38/82
2,666,274 A * 1/1954 Sokolik ..... 38/93
2,792,977 A * 5/1957 Klein ..... 223/36

(Continued)

FOREIGN PATENT DOCUMENTS

JP 03-188900 8/1991

(Continued)

*Primary Examiner*—Ismael Izaguirre
(74) *Attorney, Agent, or Firm*—Ladas and Parry LLP

(57) ABSTRACT

Disclosed is an iron having a soleplate capable of easily pleating cloth, as well as ironing the cloth. The iron 10 includes a soleplate 13 and a body positioned on the soleplate and having a switch 12 and a handle 11 installed thereon. A connecting plate 14, which is provided with operating spaces 16 formed on front and rear surfaces thereof, is fixed to a bottom of the body. Guides 15 are formed on the front and rear surfaces, opposite to the operating spaces. The soleplate 13 provided with a space 19 corresponding to the guides 15 is assembled to the guides 15 using fastening bolts 20, which is inserted into a spring 21. The heat coils 17 serving as a heat source are built in the connecting plate 14 and the soleplate 13, respectively. The heat coil in the connecting plate 14 is connected to the heat coil in the soleplate 13 by a heat-coil connector 18, so that the cloth is pushed into a pleating part 22 through a mouth 23 provided between the connecting plate 14 and the soleplate 13 to pleat the cloth.

3 Claims, 7 Drawing Sheets

U.S. PATENT DOCUMENTS

| | | | | | |
|---|---|---|---|---|---|
| 3,074,192 | A | * | 1/1963 | Smith | 38/93 |
| 3,577,859 | A | * | 5/1971 | Davidson | 38/71 |
| 3,603,012 | A | * | 9/1971 | Haynes | 38/97 |
| 3,703,042 | A | * | 11/1972 | Smith | 38/69 |
| 3,760,149 | A | * | 9/1973 | Harsanyi | 219/247 |
| 4,219,724 | A | | 8/1980 | Allvin | |
| 4,642,922 | A | * | 2/1987 | Prudenziati | 38/81 |
| 4,817,309 | A | * | 4/1989 | Frank et al. | 38/15 |
| 4,845,868 | A | * | 7/1989 | Tierney et al. | 38/71 |
| 5,220,738 | A | * | 6/1993 | Baldacci | 38/81 |

FOREIGN PATENT DOCUMENTS

| | | |
|---|---|---|
| JP | 08-257299 | 10/1996 |

* cited by examiner

IRON

TECHNICAL FIELD

The present invention relates to an iron for ironing cloth, and more particularly to an iron capable of easily pleating cloth as well as ironing the cloth by improving the structure of a soleplate of a general iron.

BACKGROUND ART

In general, an iron, which may be classified into an electric type and a steam type, has a soleplate with a heat coil built in the bottom thereof, and a body positioned on the soleplate and provided with a handle and a switch. When the switch is turned on, the built-in heat coil is operated to generate heat, so that the cloth is ironed by pressing the soleplate onto the surface of the cloth.

According to the conventional iron as described above, the cloth is ironed by the heat generated from the heat coil built in the soleplate. Specifically, the cloth is spread on a floor or an ironing board, and then is ironed by a general ironing method. In the case of pleating the cloth, a portion of the cloth to be pleated is folded, and then is ironed by the soleplate of the iron.

In the case of ironing the surface of the cloth with the conventional iron, the soleplate of the iron is pressed on the flat surface of the cloth, so that the cloth is smoothed. In the case of pleating the cloth, the portion of the cloth to be pleated is folded, and then is ironed by the soleplate of the iron. Then, the cloth is turned over, and the opposite portion is ironed by the soleplate. Therefore, the pleating work is very cumbersome and difficult.

In addition, if the cloth is not accurately turned over, several wrinkles may be frequently formed on the cloth by mistake. Accordingly, the ironing is cumbersome work.

In particular, since the pleats are not properly formed and a user should iron the cloth entirely according to the conditions of ironing, the efficiency of the ironing is greatly lowered, and it is very difficult to properly pleat the cloth.

In the case of ironing a shirt or trousers with a conventional iron, even an unskilled person can smooth the surface of the cloth by ironing the cloth. In the case of pleating the cloth, however, only a skilled person can properly pleat the cloth.

In ironing the cloth in a conventional manner, a user spreads the cloth on a floor or an ironing board, without making any fold on the cloth, and then performs the ironing as moving the iron back and forth.

Since the bottom surface of the soleplate is made of a solid (metal) material while the ironing board is made of a soft (fiber) material, the cloth is slid between the iron and the ironing board when the iron is moved back and forth, so that the pleats are altered. In order to prevent double pleats from being created in the cloth, it is required for the user to press the cloth that is spread on the floor with one hand, and simultaneously to hold the iron with the other hand. This cumbersome work causes a time loss, and the user should pay thoughtful attention to pleat the cloth. Whenever the cloth is turned over, the cloth and the iron are repeatedly moved, and this causes a significant load to be imposed on the shoulder of a beginner or woman who pleats the cloth.

DISCLOSURE

Technical Problem

Therefore, the present invention has been developed in order to solve the above drawbacks and other problems associated with the conventional iron. It is an object of the present invention to provide an iron capable of easily pleating cloth as well as ironing the cloth by improving the structure of a soleplate of the iron.

Technical Solution

In order to achieve the above object and other objects, there is provided is an iron including a soleplate and a body positioned on the soleplate and having a switch and a handle installed thereon. A connecting plate, which is provided with operating spaces formed on front and rear surfaces thereof, is fixed to a bottom of the body. Guides are formed on the front and rear surfaces, opposite to the operating spaces. The soleplate provided with a space corresponding to the guides is assembled to the guides using fastening bolts, which is inserted into a spring. The heat coils serving as a heat source are built in the connecting plate and the soleplate, respectively. The heat coil in the connecting plate is connected to the heat coil in the soleplate by a heat-coil connector, so that the cloth is pushed into a pleating part through a mouth provided between the connecting plate and the soleplate to pleat the cloth.

Specifically, when the soleplate and the connecting plate are assembled to the iron by the fastening bolts resiliently urged by the spring, a gap is formed between the soleplate and the connecting plate by the resilient force of the spring. Accordingly, the pleating part is entirely formed along the edges of the soleplate and connecting plate. The entire surface of the cloth is smoothed by the soleplate. In the case of pleating the cloth, the cloth to be pleated is inserted into the pleating part, and thus the cloth can be easily pleated using the curved surface.

Although an iron is mainly classified into an electric type iron and a steam type iron, the present invention is applied to both the electric and steam type irons. Accordingly, explanation of the types of the iron will be omitted, and only common functions of both the electric type iron and the steam type iron will be explained.

ADVANTAGEOUS EFFECTS

In the case of pleating the cloth with the iron according to the present invention as constructed above, the body of the iron is laid on the upper surface of a metal ironing board, and then the cloth is tightened by stretching both ends of the uncrumped pleat right and left using user's hands, so as to roughly pleat the cloth. After the pleat of cloth is pushed to a guide line (e.g., end part of the curved surface) along the curved surface of the pleating part through the mouth of the iron, the cloth is moved right and left to perform the ironing using the weight of the iron body and the upper and lower heat sources. A narrow portion between buttons is easily pressed by the triangular front part of the iron. After the cloth is positioned between the soleplate and the connecting plate, the iron is moved back and forth, in a state where the load of the iron is increased by pressing the handle down, thereby accurately and strongly pleating the cloth. Further, the movement of the iron is greatly restrained to minimize time and physical losses and to reduce safety accident due to the hot iron.

DESCRIPTION OF DRAWINGS

The above aspects and features of the present invention will be more apparent by describing certain embodiments of the present invention with reference to the accompanying drawings, in which.

BEST MODE

Certain embodiments of the present invention will be described in greater detail with reference to the accompanying drawings.

Figure 1:
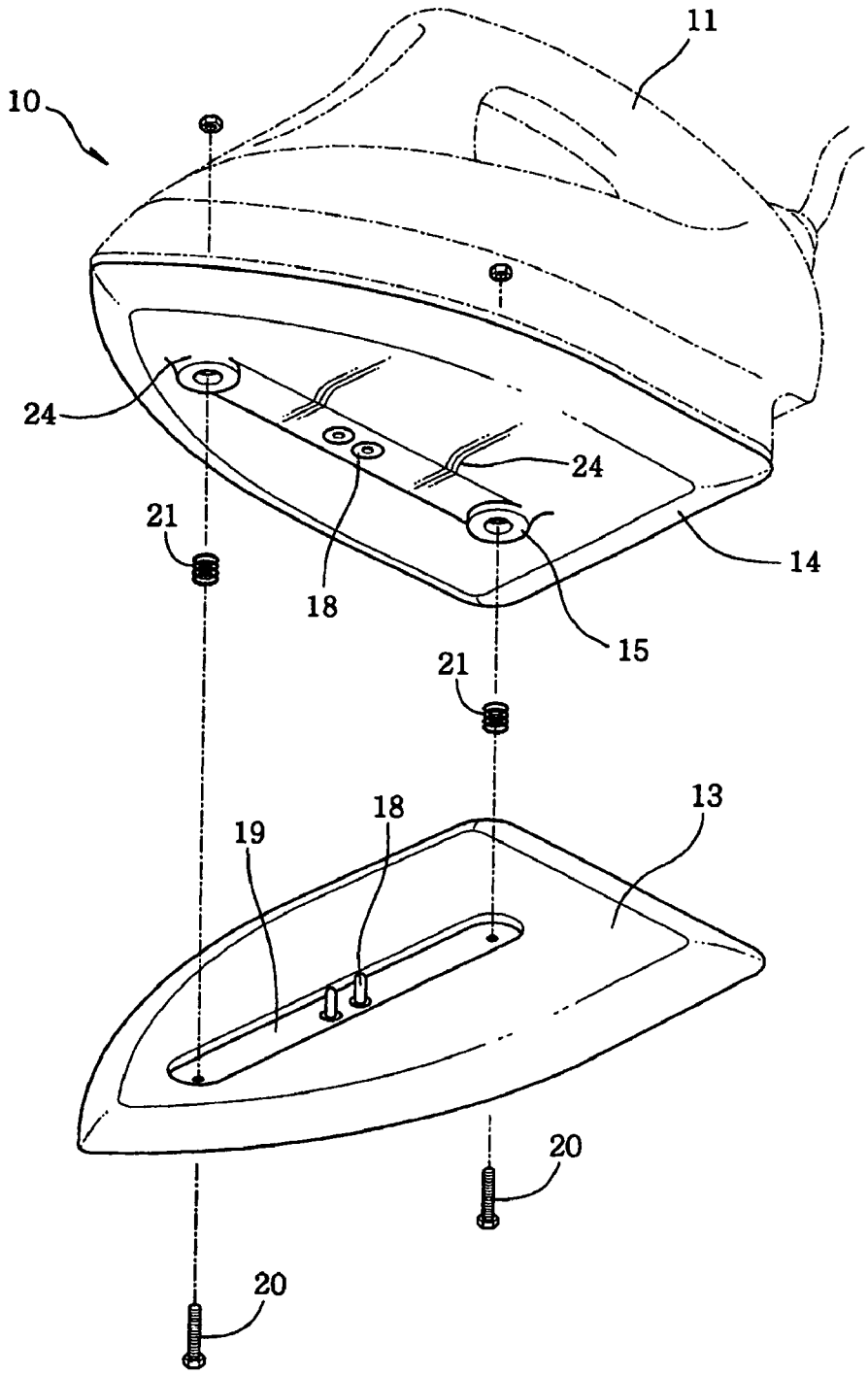
FIG. 1 is an exploded perspective view illustrating an iron according to an embodiment of the present invention.
Figure 2:
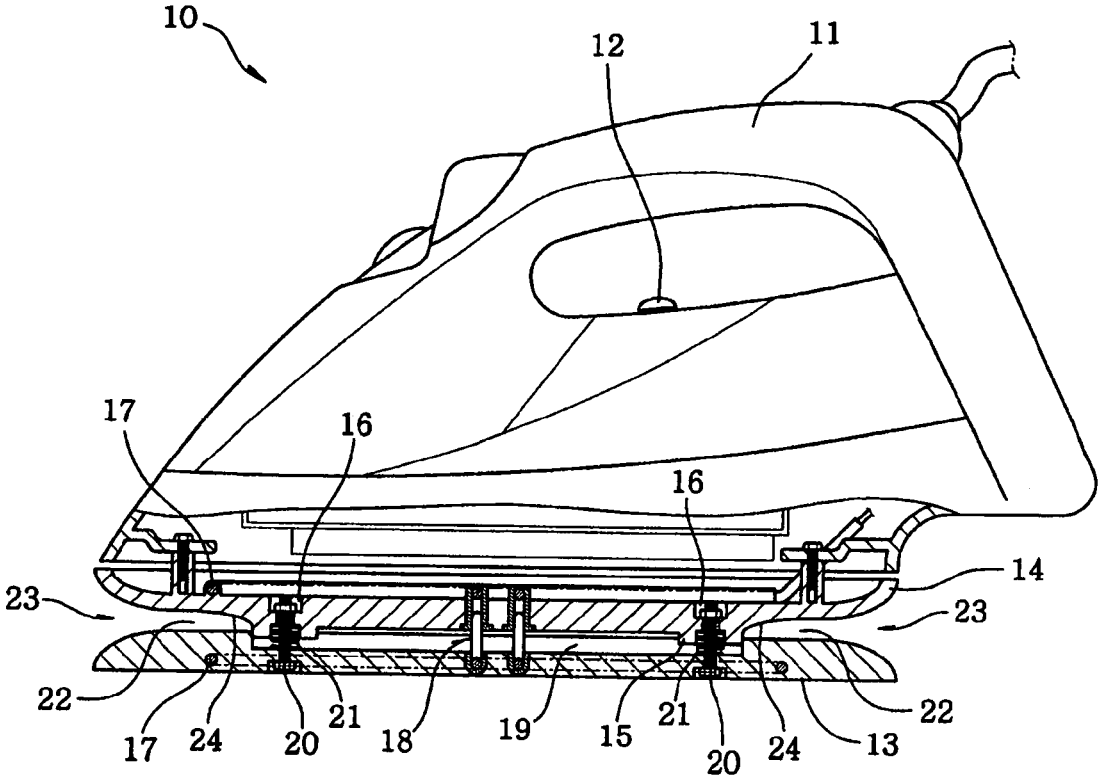
FIG. 2 is a partially cross-sectional view illustrating the internal construction of an iron according to the present invention.
Figure 3:
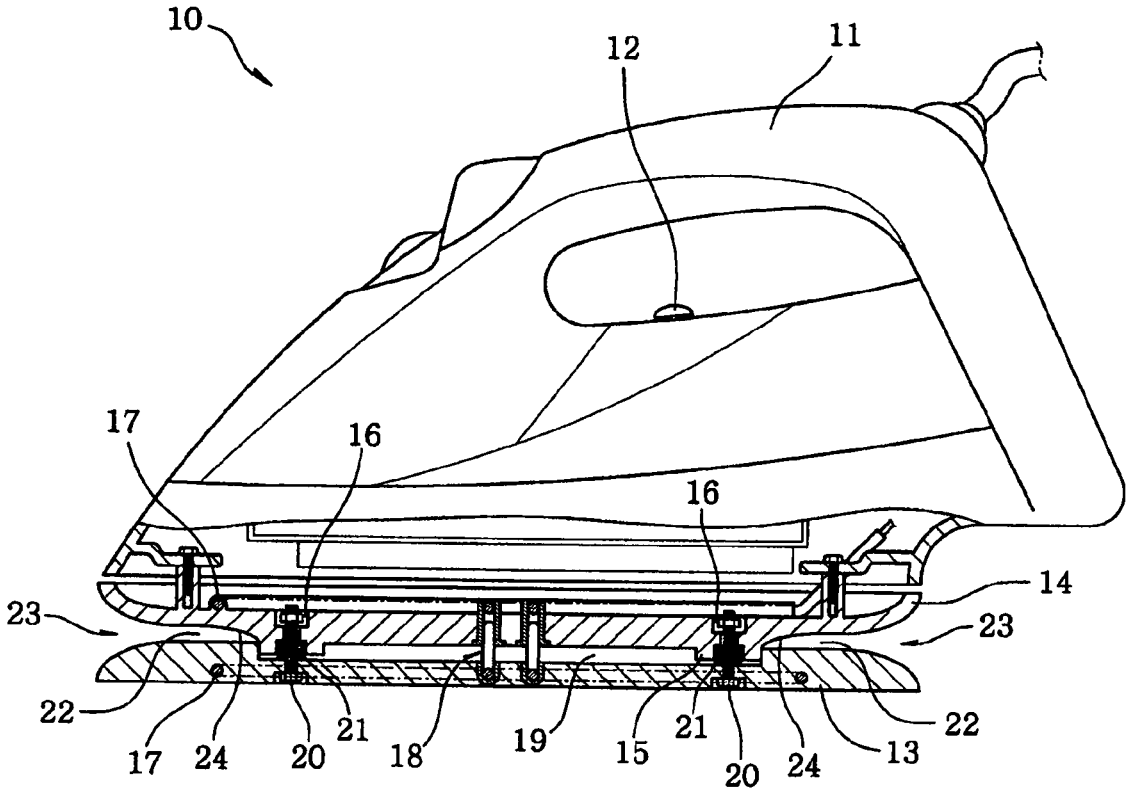
FIG. 3 is a partially cross-sectional view explaining the operation of the iron shown in FIG. 2.
Figure 4:
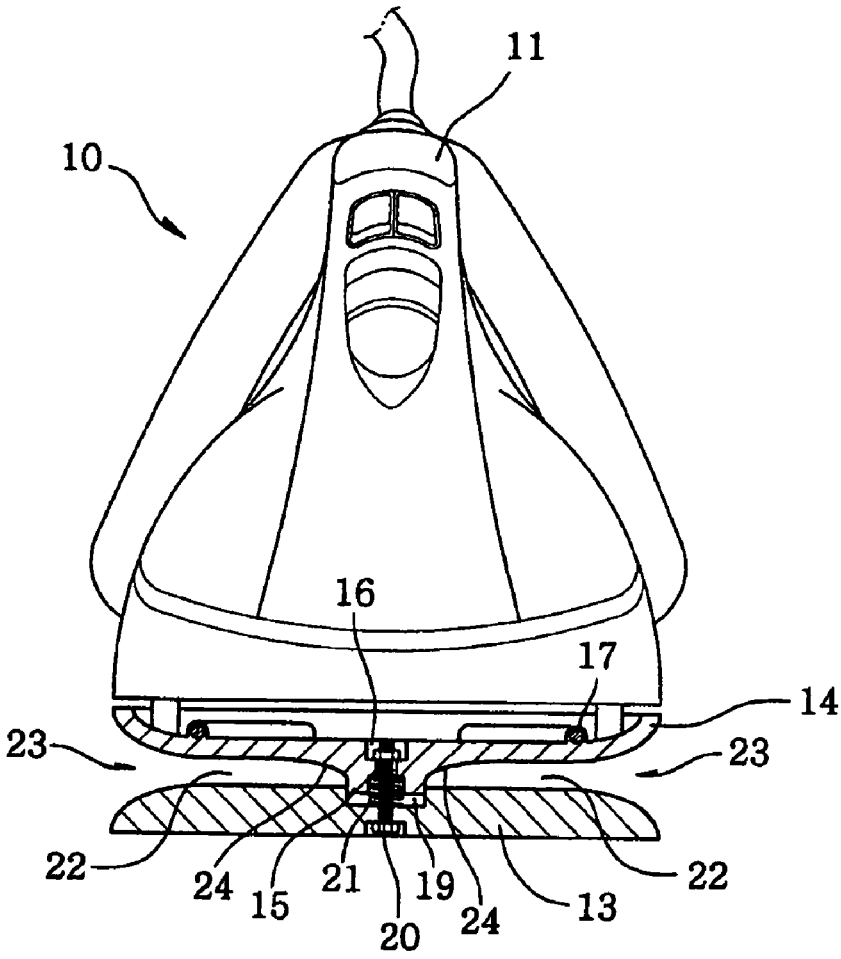
FIG. 4 is a partially cross-sectional view illustrating the internal construction of an iron according to the present invention.
Figure 5:
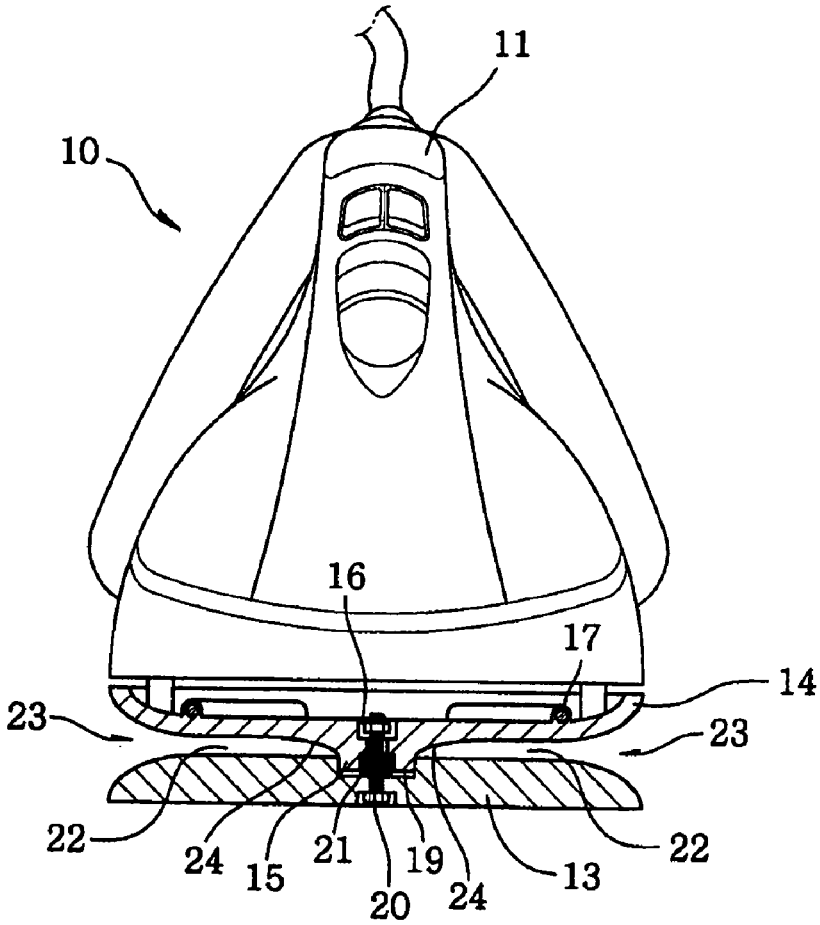
FIG. 5 is a partially cross-sectional view explaining the operation of the iron shown in FIG. 4.
Figure 6:
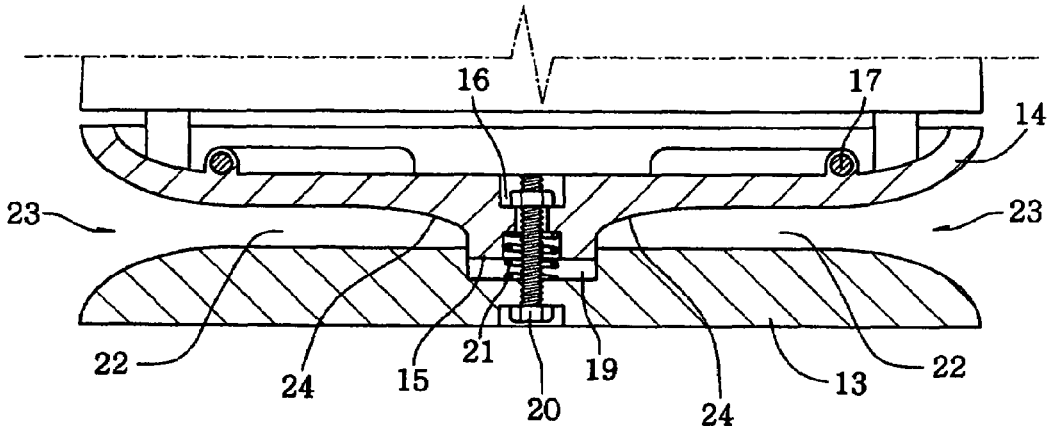
FIG. 6 is an enlarged cross-sectional view illustrating the main components of an iron according to the present invention.
Figure 7:
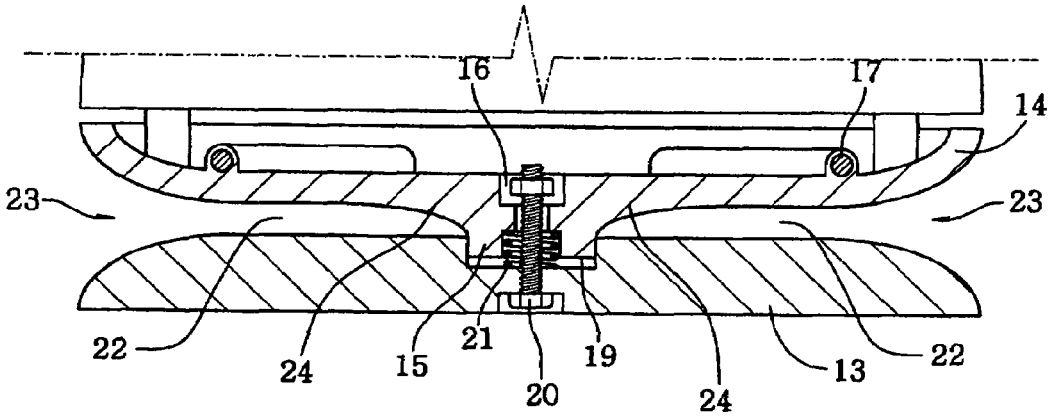
FIG. 7 is a cross-sectional view illustrating the operation of the iron shown in FIG. 6.
Figure 8:
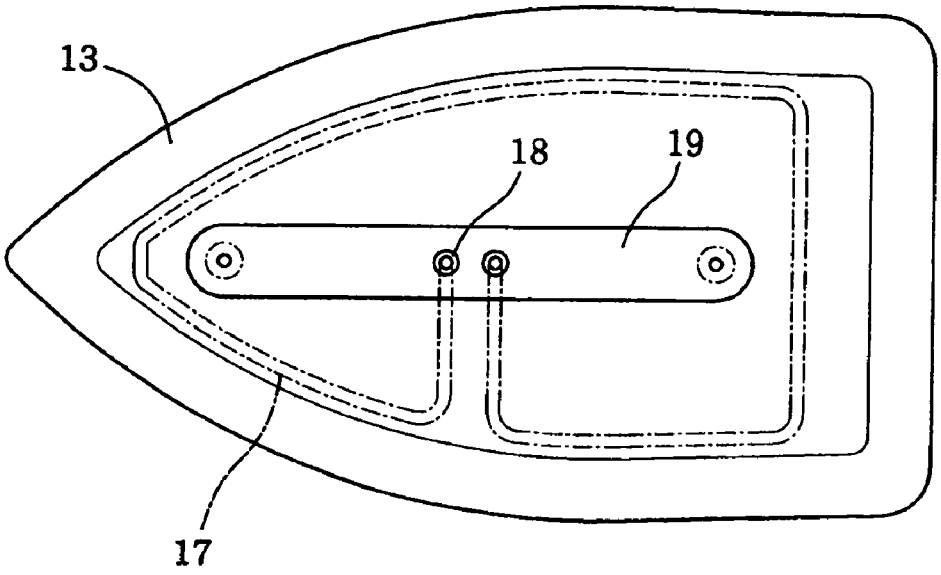
FIG. 8 is a view illustrating a heat coil of a soleplate according to the present invention.
Figure 9:
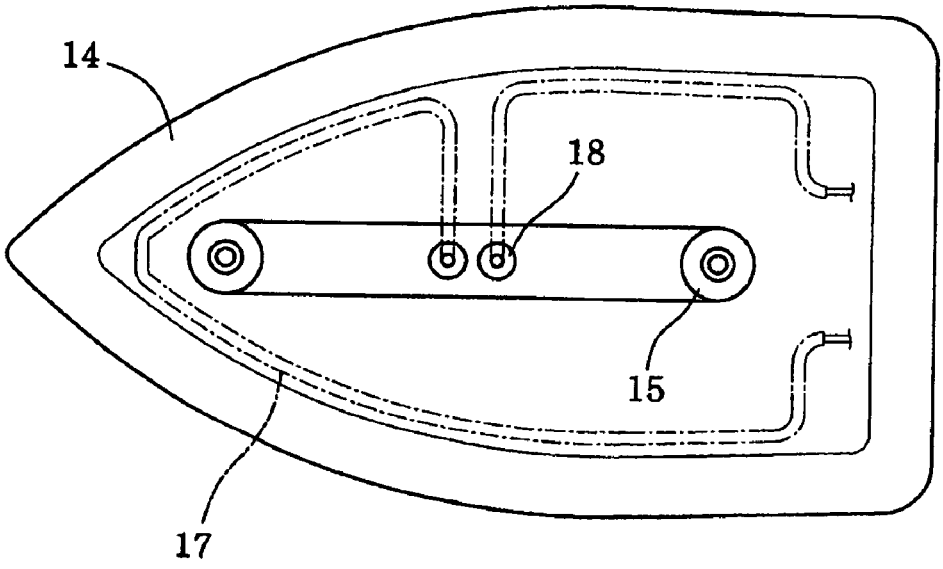
FIG. 9 is a view illustrating a heat coil of a connecting plate according to the present invention.

FIG. 1 is an exploded perspective view illustrating an iron according to an embodiment of the present invention, and FIG. 2 is a partially cross-sectional view illustrating the interior construction of the iron according to the present invention.

An iron 10 of the present invention includes a soleplate 13 and a body positioned on the soleplate and having a switch 12 and a handle 11 installed thereon.

A connecting plate 14, which is provided with operating spaces 16 formed on front and rear surfaces thereof, is fixed to a bottom of the body. Guides 15 are formed on the front and rear surfaces, opposite to the operating spaces. The soleplate 13 provided with a space 19 corresponding to the guides 15 is assembled to the guides 15 using fastening bolts 20, which is inserted into a spring 21.

Heat coils 17 serving as a heat source are built in the connecting plate 14 and the soleplate 13, respectively. The heat coil in the connecting plate 14 is connected to the heat coil in the soleplate 13 by a heat-coil connector 18, so that the cloth is pushed into a pleating part 22 through a mouth 23 provided between the connecting plate 14 and the soleplate 13 to pleat the cloth.

The soleplate 13 and the connecting plate 14 are respectively connected to the guide 15 and the space 19. The soleplate 13 is movably assembled to the space 19 by the fastening bolts 20 which are resiliently urged by the spring 21, so that the soleplate 13 is moved within a predetermined distance from the iron 10. Therefore, the moving distance of the soleplate 13 can be adjusted according to the thickness of the cloth and the degree of the pleat.

A curved surface 24 is additionally formed on the inside of the pleating part 22 of the mouth 23 provided between the soleplate 13 and the connecting plate 14, so as to accurately pleat the cloth and prevent the double pleats.

Although the pleating part 22 of the mouth 23 may be formed along the entire outer periphery of the iron 10, the pleating part may be formed in the front part and in both side parts, if necessary. In particular, a curvature of the curved surface 24 of the pleating part 22 may be altered so as to easily and accurately position the folded portion of the cloth.

More specifically, the present invention improves the construction of the iron 10 including the soleplate 13, the body positioned on the soleplate and having the switch 12 and the handle 11 installed thereon, and the heat coils 17 serving as the heat source built in the connecting plate 14 and the soleplate 13, respectively, in which the soleplate 13 and the connecting plate 14 are separately formed, and the pleating part 22 and the mouth 23 are additionally provided in the iron, so that the folded portion of the cloth is jammed into the pleating part to automatically pleat the cloth.

The connecting plate 14 having the guide 15 and the heat coil 17 built therein is connected to the bottom of the iron 10, and the soleplate 13 is movably assembled to the connecting plate 14. The heat coils 17 built in the soleplate 13 and connecting plate 14 are simultaneously supplied with an electric power through the heat-coil connector 18. The soleplate 13 is provided on the center surface thereof with the space 19 in such a way that a proper gap is formed between the soleplate 13 and the connecting plate 14 when the iron is assembled. Accordingly, the gap between the soleplate 13 and the connecting plate 14 can be adjusted by pressing the iron down.

Specifically, when the soleplate 13 and the connecting plate 14 are assembled to the iron 10 by the fastening bolts 20 resiliently urged by the spring 21, the gap is formed between the soleplate 13 and the connecting plate 14 by the resilient force of the spring 21. Accordingly, the pleating part 22 is entirely formed along the edges of the soleplate 13 and connecting plate 14. The entire surface of the cloth is smoothed by the soleplate 13. In the case of pleating the cloth, the folded portion to be pleated is inserted into the pleating part 22, and thus the cloth is easily pleated using the curved surface 24.

The function and operation of the iron according to the present invention will now be described in detail.

In the case of ironing the cloth, a user spreads out the portion to be ironed, and then turns the switch 12 on to supply the power to the iron. The user holds the handle 11 using one hand, and presses the soleplate 13 onto the portion of the cloth, so that the cloth is smoothed through the general ironing.

In the case of pleating the cloth, the user folds the portion to be pleated, and then pushes the folded portion in the mouths 23 formed at edges of the iron 10, so that the folded portion of the cloth is slid toward the pleating part 22.

When the folded portion of the cloth is slid in the pleating part, the folded portion is ironed by the soleplate 13 and the connecting plate 14, in which the heat coils 17 are respectively built. The heat coils 17 are supplied with the power by the switch 12. The pleating part 22 is provided with the curved surface 24, so that the folded portion of the cloth easily enters into the pleating part 22 in a closely contact state to accurately pleat the cloth.

Although the pleating part 22 provided in the mouth 23 is enlarged in the figures, the width of the mouth 23 is very narrow in view of the thickness of the folded portion of the cloth.

In the case where the thickness of the cloth is varied according to the seasons, the user pushes the handle 11 of the iron 10 in a state where the folded portion of the cloth is positioned in the pleating part 22, and thus a proper gap is formed between the operating space 16 and the space 19 by the resilience of the spring 21 and the fastening bolts 20 interposed between the soleplate 13 and the connecting plate 14, which performs the ironing suitable for the thickness of the cloth according to the season. Therefore, the iron according to the present invention can accurately and easily pleat the cloth.

In particular, in a state where the iron 10 is fixed by additional fixing means (e.g., a simple table made of material having low thermal conduction) and the cloth is positioned in the pleating part 22 through the mouth 23, one user pushes the handle 11 down, and the other user pleats the cloth. Alternatively, two users can simultaneously pleat the cloths at both sides.

Although it is not described and shown herein, the soleplate 13 and the connecting plate 14 may be formed in such a way that left and right gaps between the upper surface of the soleplate 13 and the lower surface of the connecting plate 14 are different from each other. The wide gap is dedicated to the thick cloth such as trousers, and the upper surface of the body corresponding to the position of interest may be marked as "For Thick Cloth Only." The narrow gap is dedicated to the thin cloth such as a shirt, and the upper surface of the body corresponding to the position of interest may be marked as "For Thin Cloth Only." Therefore, the resilience of the spring 21 or the pleating error of the curved surface 24 due to the thickness of the cloth is minimized. Also, one user can pleat the thick cloth such as trousers, and simultaneously, the other user can pleat the thin cloth such as a shirt. Accordingly, a couple of users as well as a single user can simultaneously perform the ironing.

Since it is difficult to recognize the end part of the curved surface 24 adjacent to the guide 15 protruding downwardly from the bottom of the connecting plate 14, the upper surface of the connecting plate 14 or the upper surface of the soleplate 13 may be marked by an indication line parallel to the end of the curved surface 14 which comes in contact with the guide, so that the user can easily identify whether the cloth is sufficiently pushed into the end of the curved surface 24.

INDUSTRIAL APPLICABILITY

As described above, the present invention improves the construction of the iron 10 capable of ironing the cloth using the heat coils 17 therein. More specifically, the soleplate 13 and the connecting plate 14 are separately formed, and the pleating part 22 and the mouth 23 are additionally provided in the iron, so that the folded portion of the cloth is jammed in the pleating part to automatically pleat the cloth. The soleplate 13 is provided with the space 19 in such a way that the proper gap is formed between the soleplate 13 and the connecting plate 14. Accordingly, the gap between the soleplate 13 and the connecting plate 14 may be adjusted by pressing the iron down, so as to accurately pleat the cloth, regardless of the quality or thickness of the cloth.

In the case of ironing the surface of the cloth, the cloth is pressed with the bottom surface of the soleplate 13. In the case of pleating the cloth, however, the user folds the portion to be pleated, and then pushes the folded portion in the mouths 23 formed at edges of the iron 10, so that the folded portion of the cloth is slid toward the pleating part 22 to pleat the cloth.

The foregoing embodiment and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

The invention claimed is:

1. An iron including a soleplate (13) and a body positioned on the soleplate and having a switch (12) and a handle (11) installed thereon, the iron comprising:

a connecting plate (14) provided with operating spaces (16) formed on front and rear surfaces thereof and fixed to a bottom of the body, the connecting plate having guides (15) formed on the front and rear surfaces thereof, opposite to the operating spaces;

wherein the soleplate (13) provided with a space (19) corresponding to the guides (15) is assembled to the guides (15) using fastening bolts (20), each of which is inserted into a spring (21); heat coils (17) serving as a heat source are built in the connecting plate (14) and the soleplate (13), respectively; and the heat coil in the connecting plate (14) is connected to the heat coil in the soleplate (13) by a heat-coil connector (18), so that cloth is pushed into a pleating part (22) through a mouth (23) provided between the connecting plate (14) and the soleplate (13) to pleat the cloth.

2. The iron as claimed in claim 1, wherein the soleplate (13) and the connecting plate (14) are respectively connected to the guide (15) and the space (19), and the soleplate (13) is movably assembled to the space (19) by the fastening bolts (20) which are resiliently urged by the spring (21), so that the soleplate (13) is moved within a predetermined distance from the iron (10), and a moving distance of the soleplate (13) is adjusted according to a thickness of the cloth and a degree of pleat.

3. The iron as claimed in claim 1, wherein a curved surface (24) is additionally formed on an inside of the pleating part (22) of the mouth (23) provided between the soleplate (13) and the connecting plate (14) so as to accurately pleat the cloth and prevent double pleats.

* * * * *